US007997050B2

(12) United States Patent
Dussault

(10) Patent No.: US 7,997,050 B2
(45) **Date of Patent: *Aug. 16, 2011**

(54) METHOD OF CLAMPING OVERLAYING SHEETS OF MATERIAL

(76) Inventor: Jacques Dussault, Beaumont (CA)

( * ) Notice: Subject to any disclaimer, the term of this patent is extended or adjusted under 35 U.S.C. 154(b) by 0 days.

This patent is subject to a terminal disclaimer.

(21) Appl. No.: 12/559,776

(22) Filed: Sep. 15, 2009

(65) Prior Publication Data

US 2010/0000072 A1 Jan. 7, 2010

Related U.S. Application Data

(63) Continuation of application No. 11/832,999, filed on Aug. 2, 2007, now Pat. No. 7,607,280.

(60) Provisional application No. 60/834,793, filed on Aug. 2, 2006.

(51) Int. Cl.
*B65B 41/04* (2006.01)
*B65B 43/26* (2006.01)

(52) U.S. Cl. ..... 53/457; 53/459; 53/492

(58) Field of Classification Search ..... 53/492, 53/459, 457, 455, 384.1, 386.1, 389.1, 570, 53/571, 564, 562, 381.1; 493/309, 313; 271/19, 271/20, 10.01, 10.04, 10.14, 11, 14, 105, 271/106; *B65B 41/04, 41/14, 43/26, 43/28*
See application file for complete search history.

(56) References Cited

U.S. PATENT DOCUMENTS

| | | | | | |
|---|---|---|---|---|---|
| 1,250,990 | A | * | 12/1917 | Dexter et al. | 271/20 |
| 2,973,610 | A | * | 3/1961 | Randall | 53/571 |
| 3,253,824 | A | * | 5/1966 | Southwell et al. | 271/19 |
| 3,735,557 | A | * | 5/1973 | Hoffarth et al. | 53/386.1 |
| 3,813,094 | A | * | 5/1974 | Walton et al. | 271/19 |
| 4,244,159 | A | * | 1/1981 | Gess | 53/570 |
| 4,482,144 | A | * | 11/1984 | Glassby | 271/21 |
| 4,981,009 | A | * | 1/1991 | Gianelli | 53/570 |
| 5,142,841 | A | * | 9/1992 | Cappi et al. | 53/384.1 |
| 5,248,177 | A | * | 9/1993 | Jones et al. | 271/19 |
| 5,419,095 | A | * | 5/1995 | Yohe | 53/384.1 |
| 6,094,895 | A | * | 8/2000 | Ravizza | 53/570 |
| 6,164,637 | A | * | 12/2000 | Harari | 271/19 |
| 6,662,535 | B2 | * | 12/2003 | Pin | 53/384.1 |
| 7,607,280 | B2 | * | 10/2009 | Dussault | 53/459 |

FOREIGN PATENT DOCUMENTS

JP 01231732 A * 9/1989

* cited by examiner

*Primary Examiner* — Stephen F Gerrity
(74) *Attorney, Agent, or Firm* — Ladas & Parry LLP

(57) ABSTRACT

A clamp for sheets of material. The clamp includes a longitudinal main body with an external clamping side. The external clamping side comprises an external dragging surface for engaging a sheet of material. An internal clamping area inwardly extends from the external clamping side. The external dragging surface is at least partially movable into the internal clamping area so as to frictionally drag at least a portion of the sheet of material, engaged thereby, into the internal clamping area therewith. Clamping devices and bagging apparatus including such clamps are also disclosed. A method of clamping overlaying sheets of material is also disclosed.

6 Claims, 15 Drawing Sheets

10
12
14
16
18
20
22
23
24
25
31
33
35
44
4A
4A
76
276

10
12
14
16
18
20
22
23
24
25
33
42
44
4B
4B
57
76
276

METHOD OF CLAMPING OVERLAYING SHEETS OF MATERIAL

CROSS-REFERENCE TO RELATED APPLICATIONS

The present application is a continuation of U.S. patent application Ser. No. 11/832,999 filed on Aug. 2, 2007 which has now issued as U.S. Pat. No. 7,607,280 and which claimed priority on U.S. Provisional Application No. 60/834,793 filed on Aug. 2, 2006.

FIELD OF THE INVENTION

The present invention generally relates to a clamp. More specifically but not exclusively, the present invention is concerned with a clamp for sheets of material. Still more specifically but not exclusively, the present invention is concerned with a clamp for a bagging system.

BACKGROUND OF THE INVENTION

Clamps for sheets of material are well known in the art. Such clamps are commonly used in bagging systems.

It is known in the art to bag or package certain products, such as bundles of lumber, in order to protect them from the external environment, such as UV radiation, and preserve an appropriate degree of humidity. Apparatuses for loading forestry, agriculture or other products into stretchable plastic tubes have been provided.

Many conventional apparatuses include clamps for pulling a sheet of bagging material over a load, gripping members for turning the bag inside out over a movable bag stretching structure. The movable bag stretching structure is displaced towards a facing side of the material while being held in a stretched state. This continuous displacement causes the bag to be inverted onto the material for covering thereof.

A variety of clamps for pulling this sheet of bagging material are known in the art.

A drawback of standard clamps is that they do not sufficiently grip sheets of material for proper manipulation thereof. Other conventional do not sufficiently grip sheets of film and the like without damaging thereto or creasing thereof.

OBJECTS OF THE INVENTION

A non-exclusive object of the present invention is to provide a clamping member.

Another non-exclusive object of the present invention is to provide a clamping device.

Another non-exclusive object of the present invention is to provide an apparatus for bagging material.

Another non-exclusive object of the present invention is to provide a method for clamping overlaying sheets of material.

SUMMARY OF THE INVENTION

In accordance with an aspect of the present invention, there is provided a clamping member for sheets of material, the clamping member comprising: an external clamping side comprising an external dragging surface for engaging a sheet of material; and an internal clamping area inwardly extending from the external clamping side; wherein the external dragging surface is at least partially movable into the internal clamping area so as to frictionally drag at least a portion of the sheet of material, engaged thereby, into the internal clamping area therewith.

A clamping device for sheets of material, the clamping device comprising: a longitudinal support member; a first clamping member movably mounted to the longitudinal support member and comprising an external clamping side, the external clamping side comprising an external dragging surface for engaging a sheet of material and an internal clamping area inwardly extending from the external clamping side; and a second clamping member movably mounted to the longitudinal support member and comprising an external clamping side, the external clamping side comprising an external dragging surface for engaging a sheet of material and an internal clamping area inwardly extending from the external clamping side; wherein each external dragging surface of each first and second clamping member is at least partially movable into a respective internal clamping area so as to frictionally drag at least a portion of the sheet of material, engaged thereby, into the respective internal clamping area therewith.

An apparatus for bagging material, the apparatus comprising: a clamping device for sheets of material comprising a longitudinal support member and a clamping member movably mounted to the longitudinal support member and comprising an external clamping side, the external clamping side comprising an external dragging surface for engaging a sheet of material and an internal clamping area inwardly extending from the external clamping side, wherein the external dragging surface is at least partially movable into the internal clamping area so as to frictionally drag at least a portion of the sheet of material, engaged thereby, into the internal clamping area therewith.

A method of clamping overlaying sheets of material including at least a first sheet and a second sheet, the method comprising: engaging the first and second sheets with a respective dragging surface; frictionally dragging a portion of each first and second sheets into a respective crevice contiguous with each dragging surface; and clamping the portions of the first and second sheets within the respective crevices.

The term "clamp" is construed herein to include any type of clamping device, pinching device, gripping device and the like.

The terms "rolling" and "unrolling" are not used herein in its most strict sense and even though, the action of convention rollers is included, this term also includes without limitation the movement of rolled or semi-rolled sheets being opened, unfolded or unrolled or closed, moved towards a folded or rolled.

Other objects, advantages and features of the present invention will become more apparent upon reading of the following non-restrictive description of illustrative embodiments thereof, given by way of example only with reference to the accompanying drawings.

BRIEF DESCRIPTION OF THE DRAWINGS

In the appended non-restrictive drawings, where like references numerals indicate like elements throughout and in which:

FIG. 6 is a perspective front view of the clamping member in accordance with another non-restrictive illustrative embodiment of the present invention;

DETAILED DESCRIPTION OF ILLUSTRATIVE EMBODIMENTS

Generally stated, the invention relates to clamping members having a clamping side. The clamping side includes an external dragging surface that forms a cleavage providing a pair of oppositely disposed sheets. This cleavage forms a crevice that leads into an internal clamping area. A common junction between the oppositely disposed is mounted to an actuator and positioned within the internal clamping area. The internal clamping area is positioned between the pair of oppositely disposed sheets. The actuator acts on the common junction and thereby on the oppositely disposed sheets to pull them deeper into the clamping area or push them outwardly of the clamping area. When the clamping side abuts a sheet of material, the actuator pulls the dragging sheets inward via the common junction into the clamping area. These dragging sheets frictionally engage the sheet and frictionally drag it into the cleavage formed therebetween dragging into the clamping area. Within the clamping area pneumatic grippers pinch the dragging sheets as well as the sheet of material enveloped therebetween thereby clamping this sheet of material.

With reference to FIGS. 1A to 5E, a first non-restrictive illustrative embodiment of the present invention will now be described so as to exemplify the invention and not limit the scope thereof.

Figures 1A, 1B:
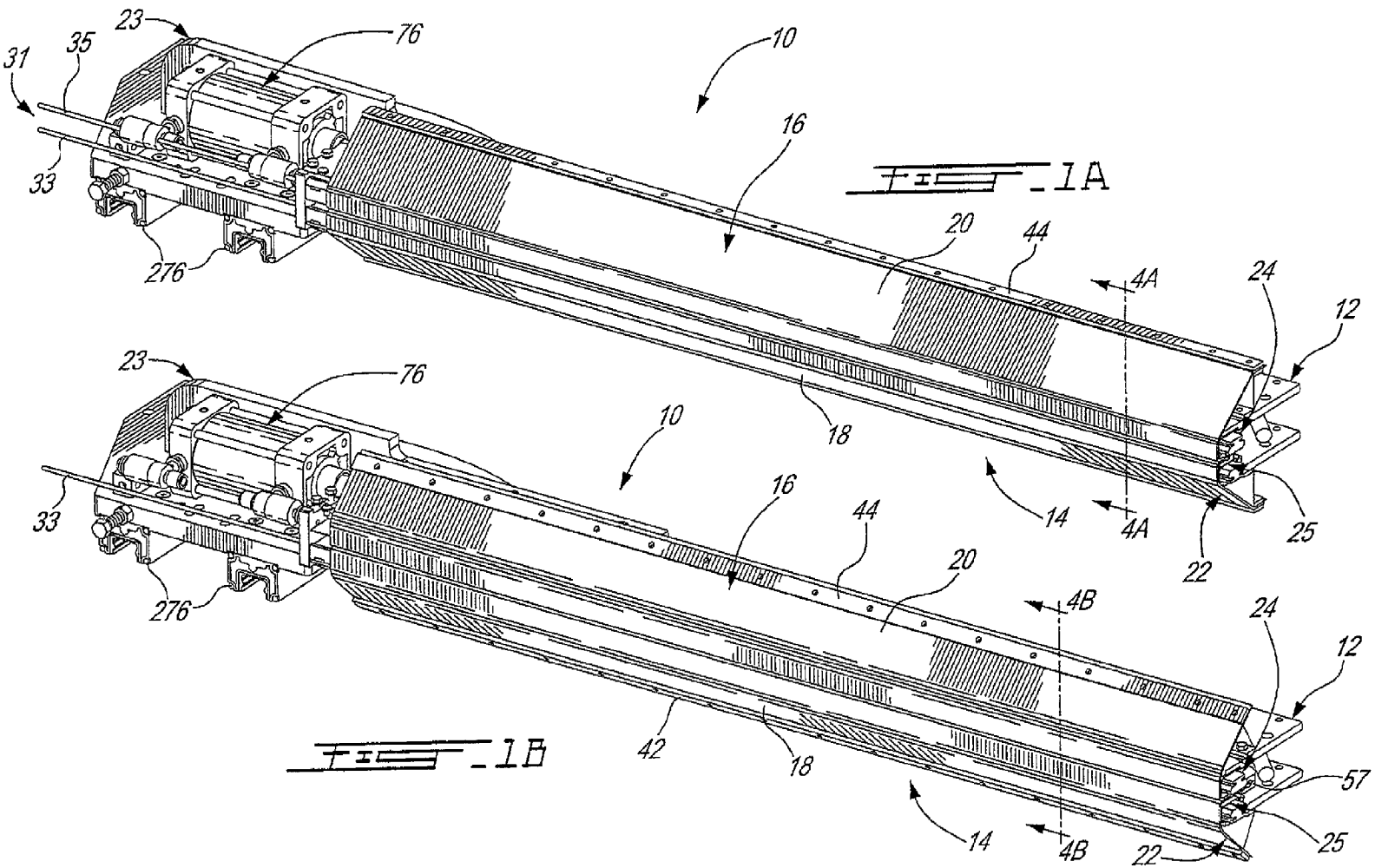
FIGS. 1A to 1C are perspective front sequential views of the clamping member in accordance with a non-restrictive illustrative embodiment of the present invention.
Figure 1C:
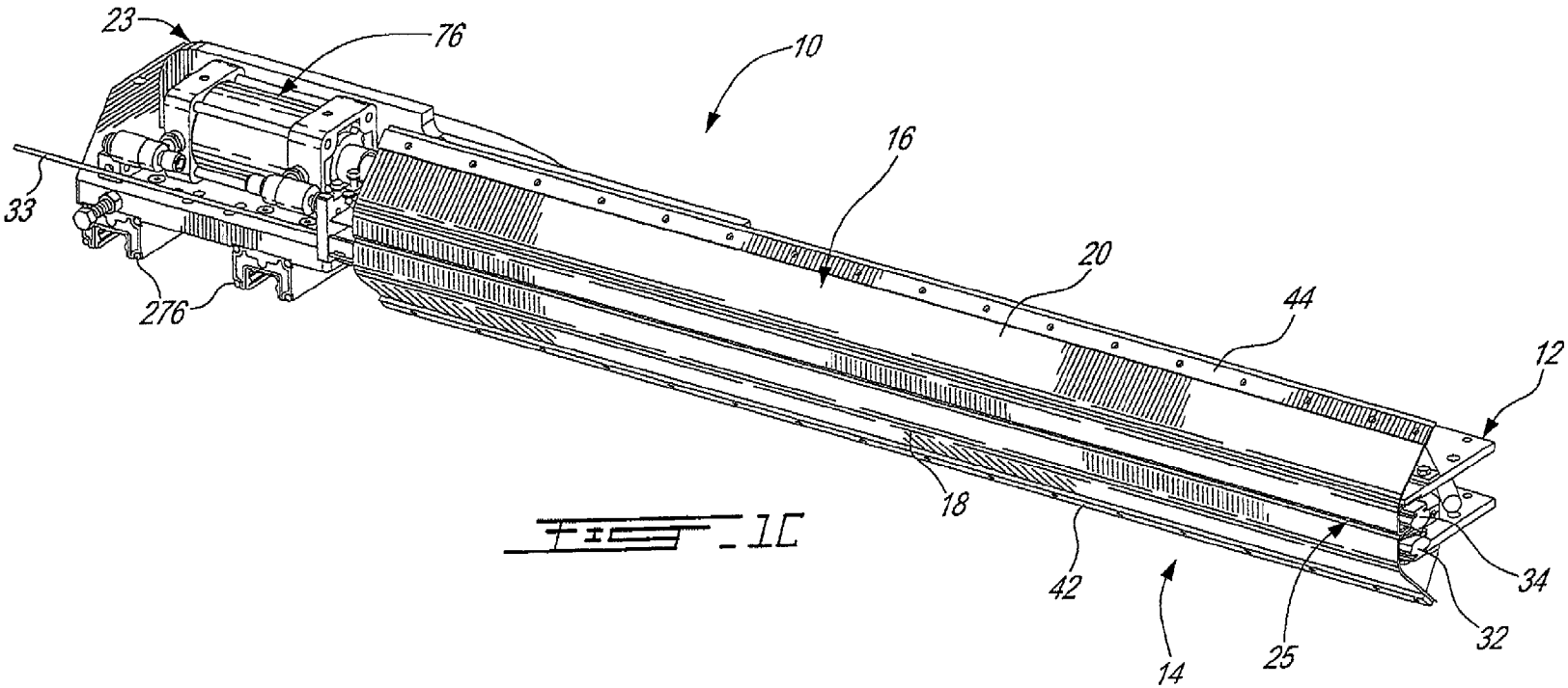

FIGS. 1A-1C show a clamp 10 including an elongate main body 12 having a clamping side 14.

The clamping side 14 includes an external dragging surface 16 defined by a pair of spaced apart dragging sheets 18 and 20 mounted to respective lip assemblies 22 and 24. With particular reference to FIGS. 4A and 4B, an internal clamping area 25 extends from the pair of spaced apart dragging sheets 18 and 20 and is positioned therebetween. Paying particular attention to FIG. 3, the elongate body 12 provides a housing having a pair of opposite outer panels 26 and 28 as well as a backing plate 29 and a structural support assembly 23 which will be discussed herein.

With particular reference to FIGS. 4A and 4B and general reference to FIG. 31 each lip assembly 22 and 24 includes a gripping or pinching members in the form of pneumatic members 30 and 32 respectively housed within an elongate support 34 and 36 respectively. The pneumatic gripping members 30 and 32 define a gripping assembly or gripper and are connected to a pneumatic actuator assembly 31 (partially illustrated in FIG. 1A). Referring to FIGS. 1A-1C and FIG. 3, the pneumatic actuator assembly 31 includes a pair of tubes 33 and 35 for providing pressure fluid in order to swell up the pneumatic gripping members 30 and 32, as shown in FIG. 1C, during clamping as will be further detailed herein. Returning to FIGS. 4A and 4B. the elongate supports 34 and 36 are mounted to members 26 and 28 via fasteners 15.

Portions of each dragging sheet 18 and 20 are interfaced within the internal clamping area 25 and joined together at common junction 37. In fact, the dragging surface 16 defines a cleavage that provides the oppositely disposed dragging sheets 18 and 20, this cleavage meets at the common junction 37. Therefore, the clamping area includes the crevice defined between external opening between the sheets 18 and 20 and the internal common junction. The opposite ends 38 and 40 of the dragging sheets 18 and 20 respectively, are clamped by fastener bars 42 and 44 and resiliently attached to members 26 and 28 respectively via respective resilient elastic members 46 and 48. The elastic members 46 and 48 are clamped by fasteners bars 42 and 44 at one end thereof and by the fasteners 50 and 52 at the other end thereof. Each gripping member 30 and 32 engages a movable clamping member in the form of plates 54 and 56, respectively, which are pivotally mounted to the elongate supports 34 and 36, respectively. The clamping members 54 and 56 define a clamper.

The common junction 37 of the dragging surface 16 is connected to actuator 57 slidably mounted between inner panels 58 and 60. The actuator 57 acts on the common junction 37 in order to move a further portion of the external dragging surface 16 into the clamping area 25 as sequentially shown in FIGS. 4A and 4B respectively. The actuator 57 includes a pair of fingers 62 and 64 which sandwich junction 37 as well as a portion of the interfaced sheets 18 and 20 defining the cleavage of the dragging surface 16.

Figures 2A, 2B:
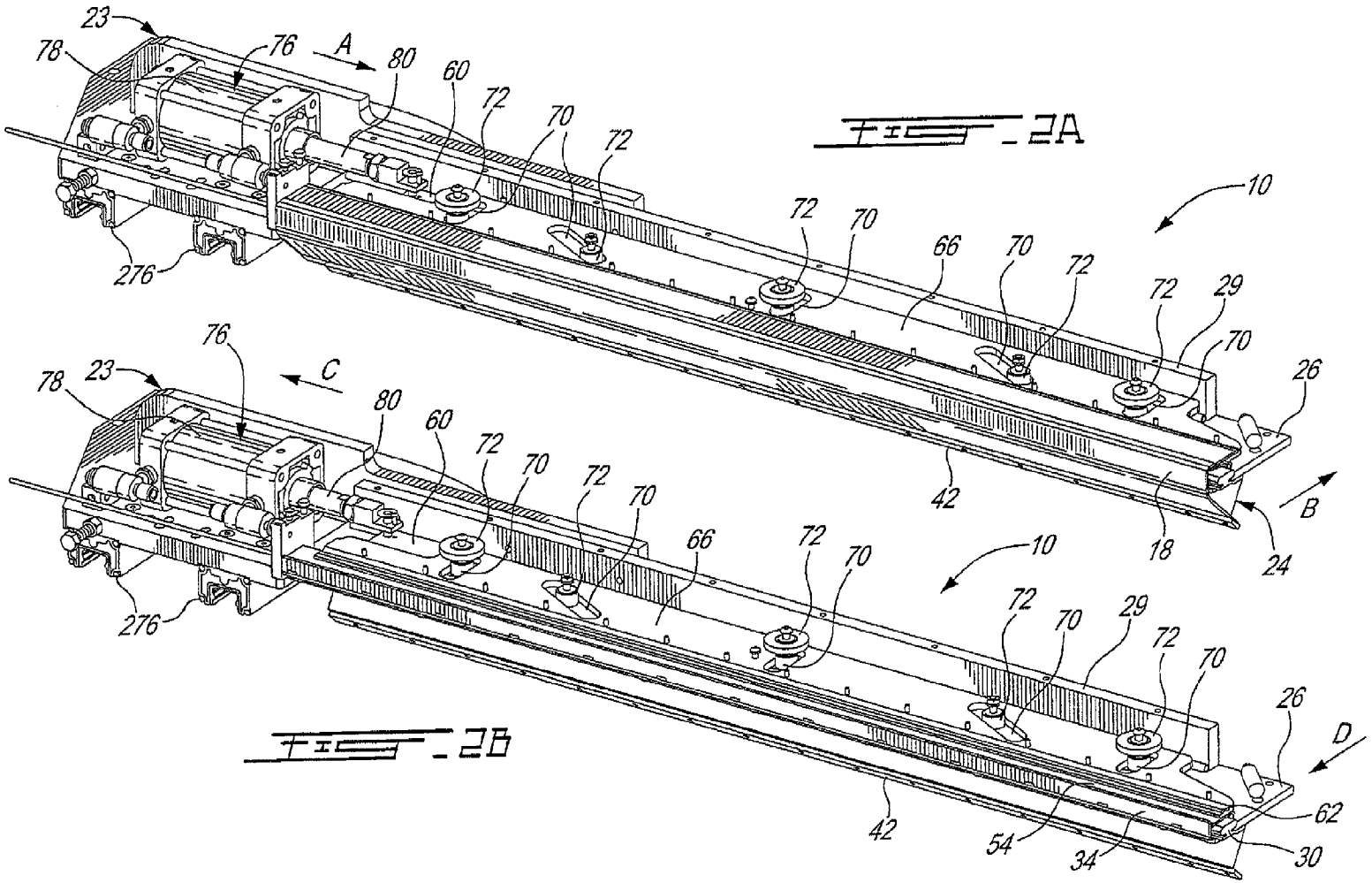
FIGS. 2A and 2B are partial perspective front views of the clamping member of FIGS. 1A to 1B.
Figure 3:
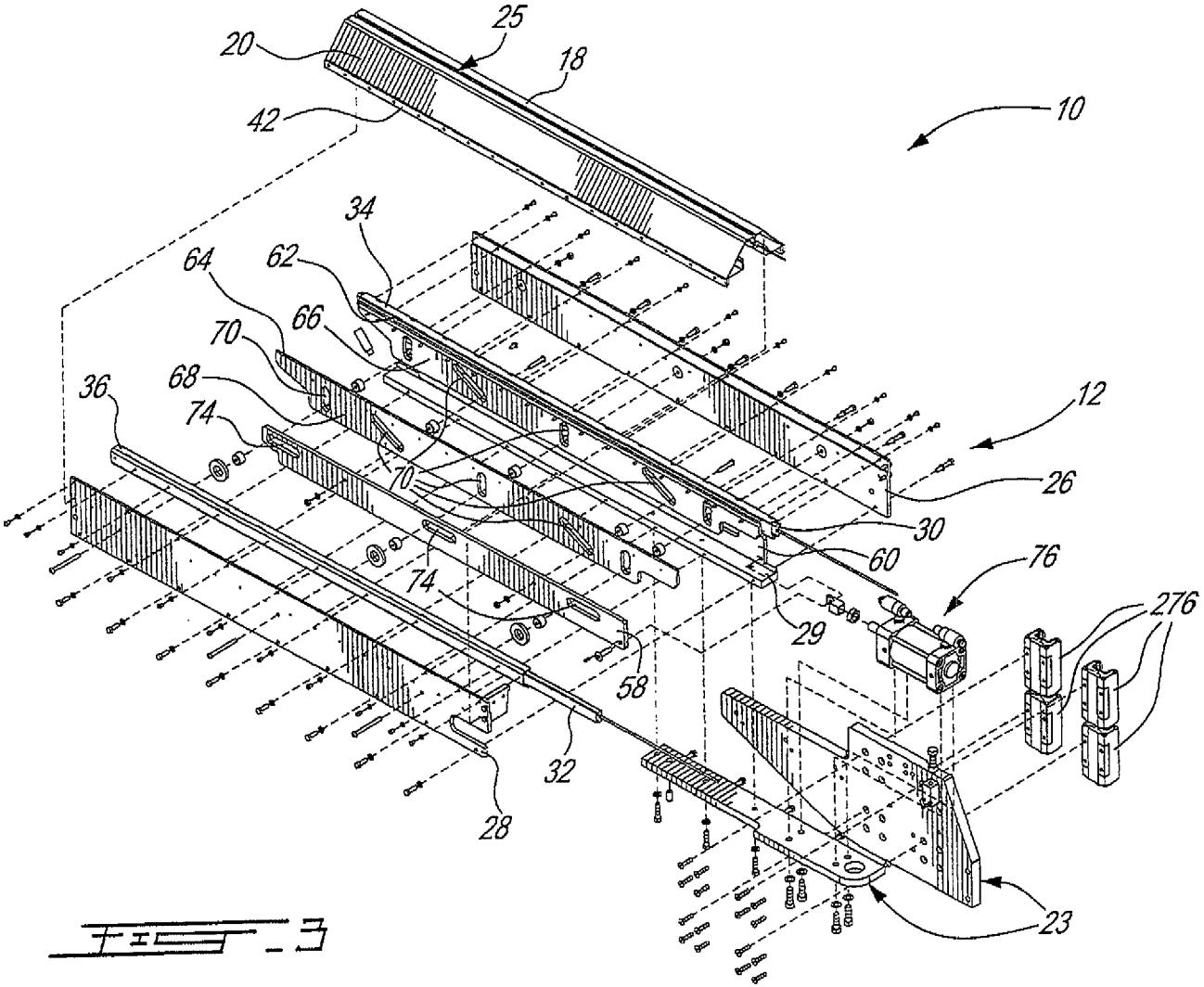
FIG. 3 is an exploded front perspective view of the clamping member of FIGS. 1A to 1B.
Figure 4A:
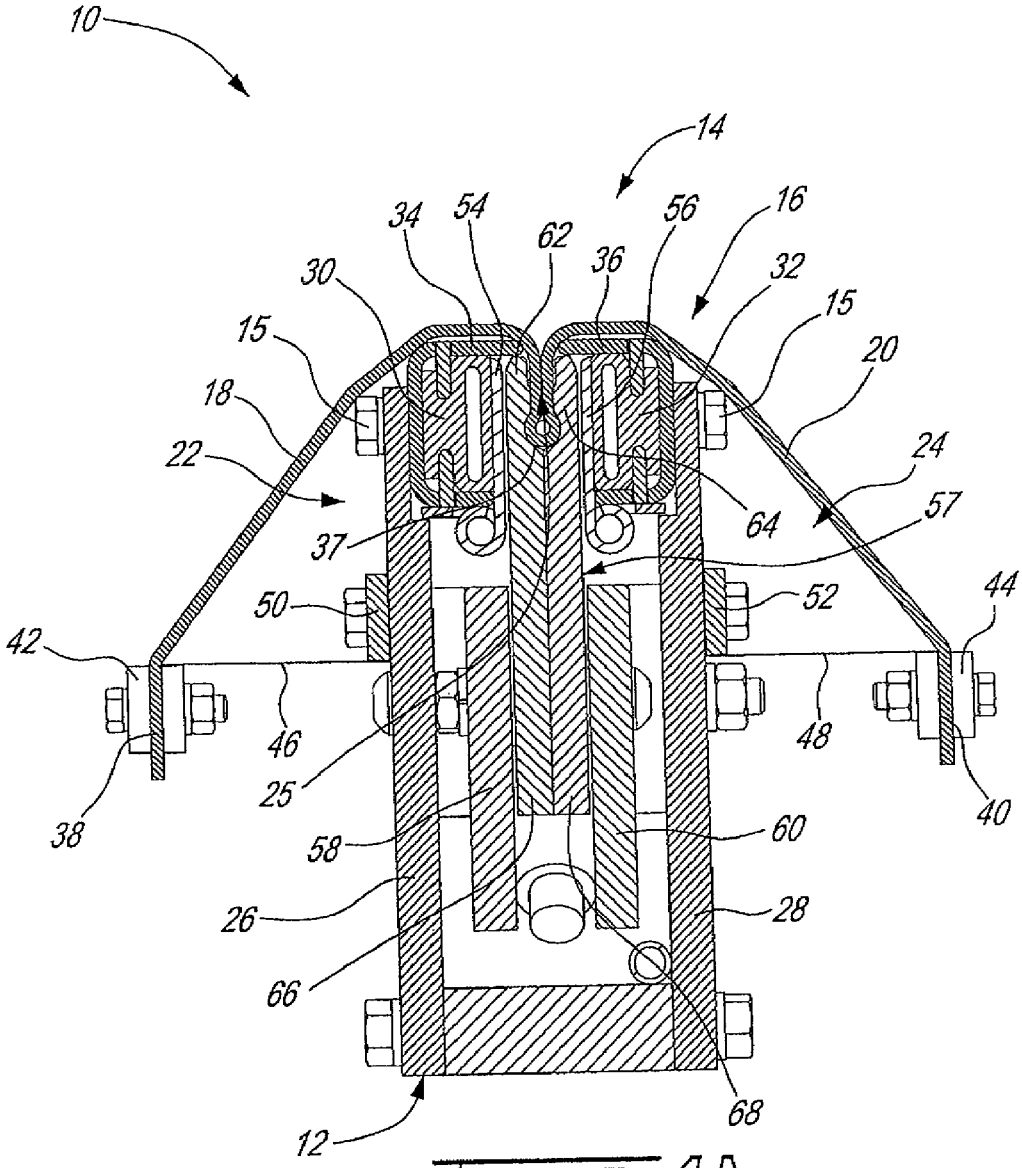
FIGS. 4A and 4B are respective partial cross-sectional views of FIGS. 1A and 1B along the lines 4A-4A and 4B-4B respectively.
Figure 4B:
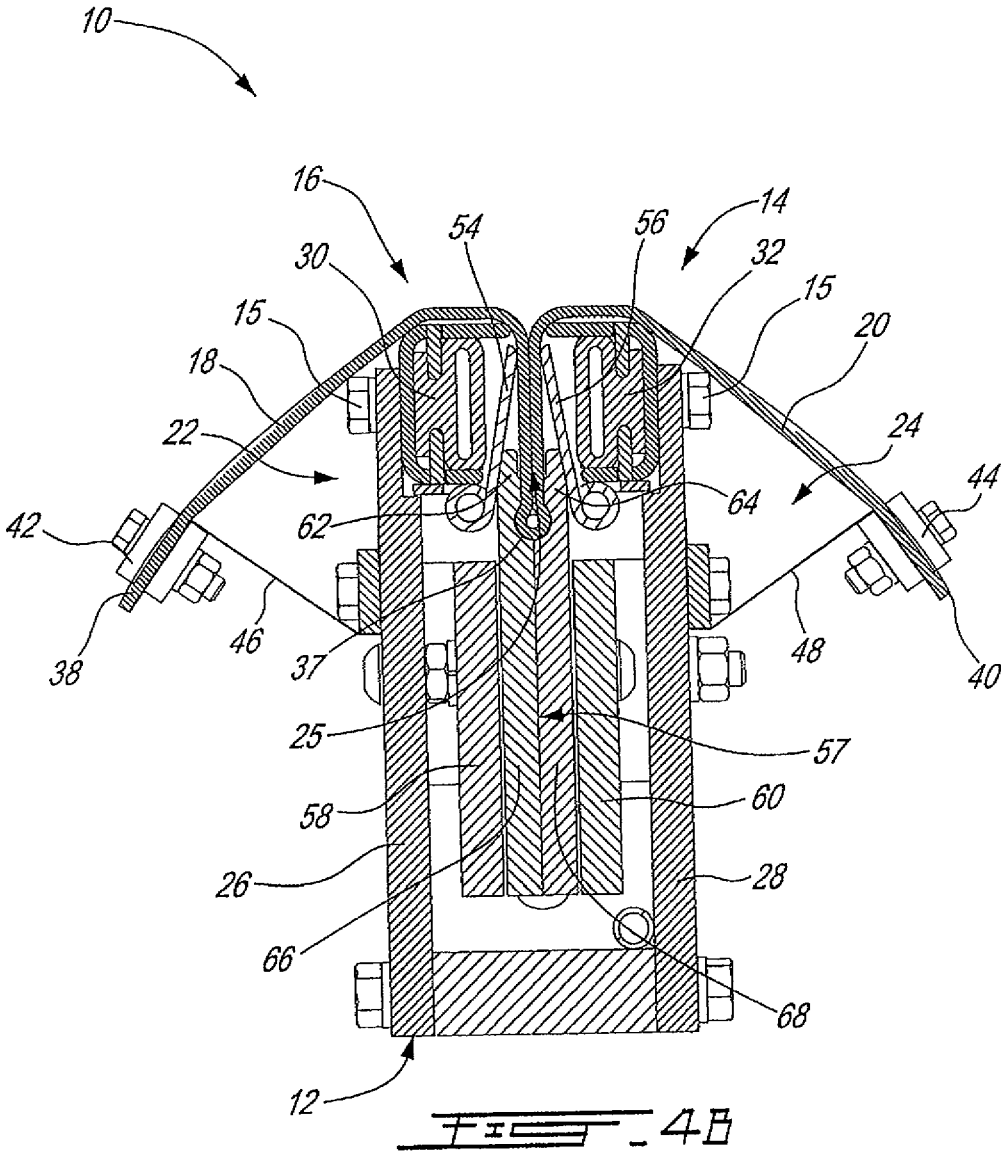

With reference to FIGS. 2A-3, the fingers 62 and 64 are the front edges of moveable guide-panels 66 and 68 respectively (also see FIGS. 4A and 4*b*). The guide-panels 66 and 68 are moveably mounted to the inner actuating panels 58 and 60 and include similarly configured guide apertures 70 for slidably receiving guide protrusions 72 therethrough. The inner actuating panels 58 and 60 also include similarly configured 74 for also slidably receiving the guide protrusions 74 therethough. The actuating panels 58 and 60 are mounted to an actuating assembly 76.

As shown in FIGS. 2A and 2B, the actuating assembly 76 is mounted to the structural support assembly 23 and includes a hydraulic cylinder 78 and a piston 80 mounted to the interconnected actuating panels 58 and 60 for movement thereof.

In operation, the cylinder 78 actuates the piston 80 to impart a movement on the actuating panels 58 and 60, which are guided during their movement via their guide apertures 74 sliding along their guide protrusions 72. The foregoing causes a complementary movement to the moveable guide-panels 66 and 68 which are guided, via their apertures 70 sliding along guide protrusions 72.

Hence, when the piston 80 is moved outwardly of the cylinder 78, as shown by arrow A in FIG. 2A, the panels 58 and 60 are pushed in direction A as well, causing the panels 66 and 68 to move inwardly as shown by arrow B. In this way, the fingers 62 and 64 are moved inwards as shown in FIG. 4B, bringing the dragging surface common junction 37 deeper into the clamping area 25. As shown, in FIG. 4B, the sheets 18 and 20 are moved towards the clamping area 25 bringing their respective clamped end 38 and 40 therewith (as well as the clamping bars 42 and 44) and hence, the movement of which is arrested by the clamped elastic members 46 and 48 when they reach a maximum stress level. The sheets 18 and 20 are pulled in quickly and their surface in under stress between the fingers 62 and 68 and the elastics 46 and 48 as such the sheets 18 and 20 frictionally engage the pivotable clamping members 54 and 56 thereby closing these members. When the piston 80 is moved into the cylinder 78, as shown by arrow C in FIG. 2B, the panels 58 and 60 are pulled in direction B, as well, causing the panels 66 and 68 to move outwardly as shown by arrow D. In this way, the fingers 62 and 64 are moved outwards as shown in FIG. 4A, moving the sheets 18 and 20 outwardly of the clamping area 25 causing the clamping members 54 and 56 to pivot as to open.

Figure 5A:
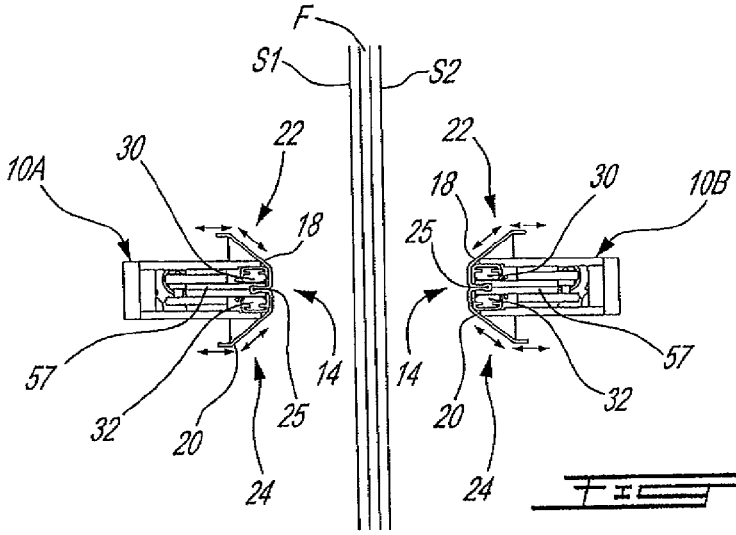
FIGS. 5A to 5E are partial cross-sectional representational views similar to FIGS. 4A and 4B showing the clamping members of FIGS. 1A to 1C in operation.
Figure 5B:
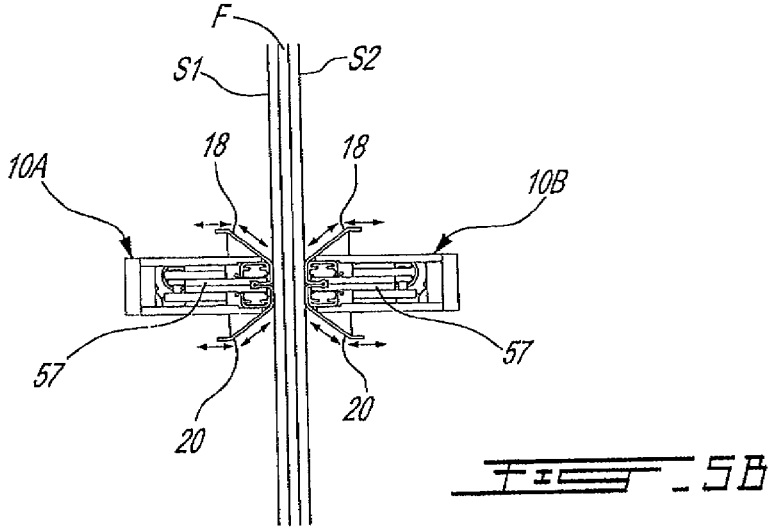
Figure 5C:
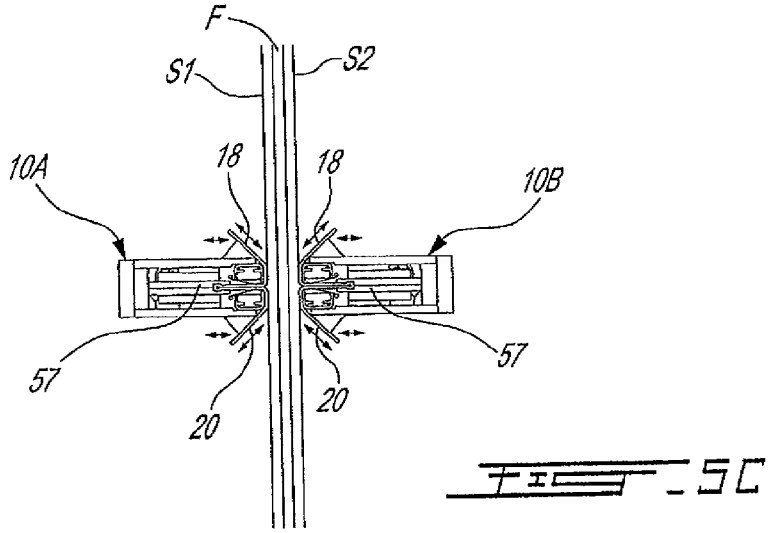
Figure 5D:
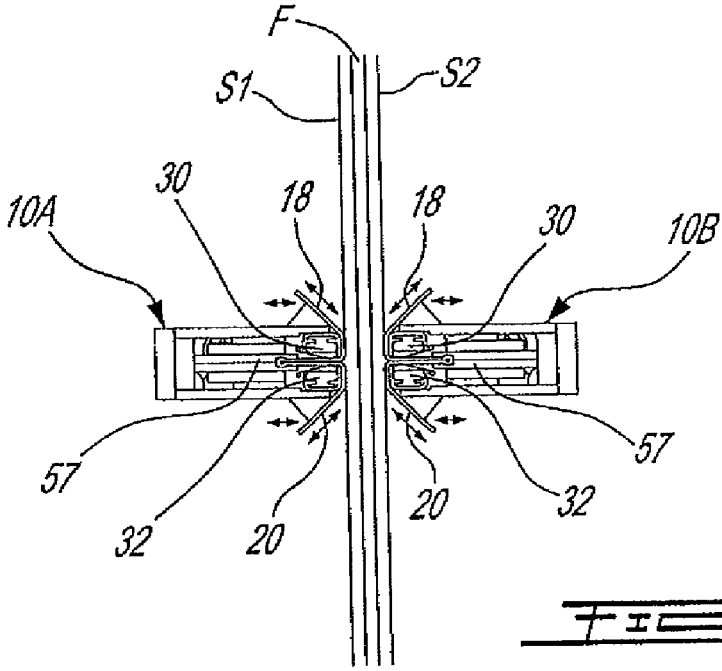
Figure 5E:
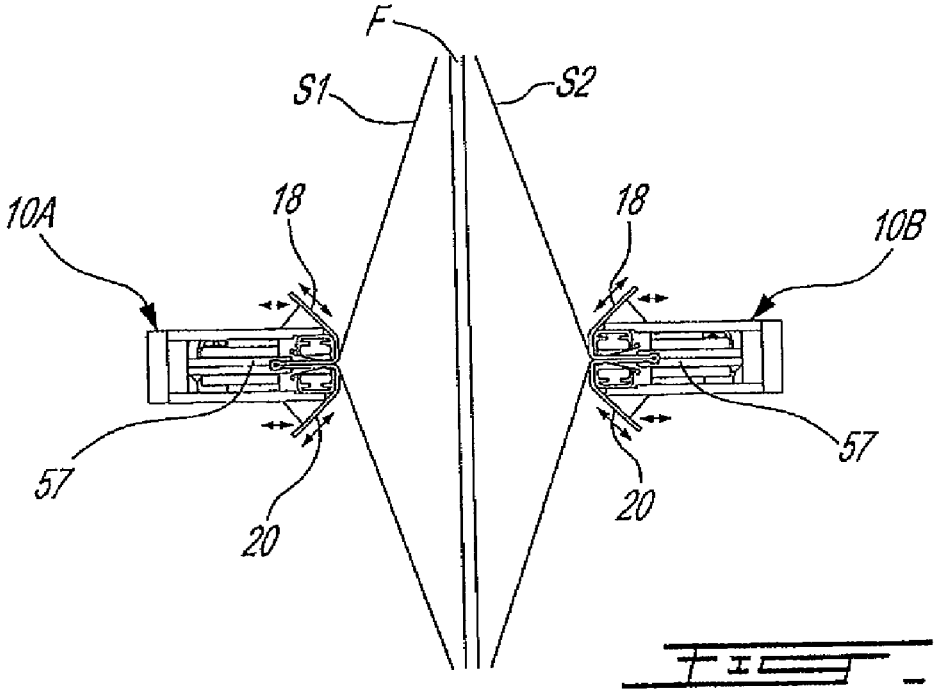
Figure 8:
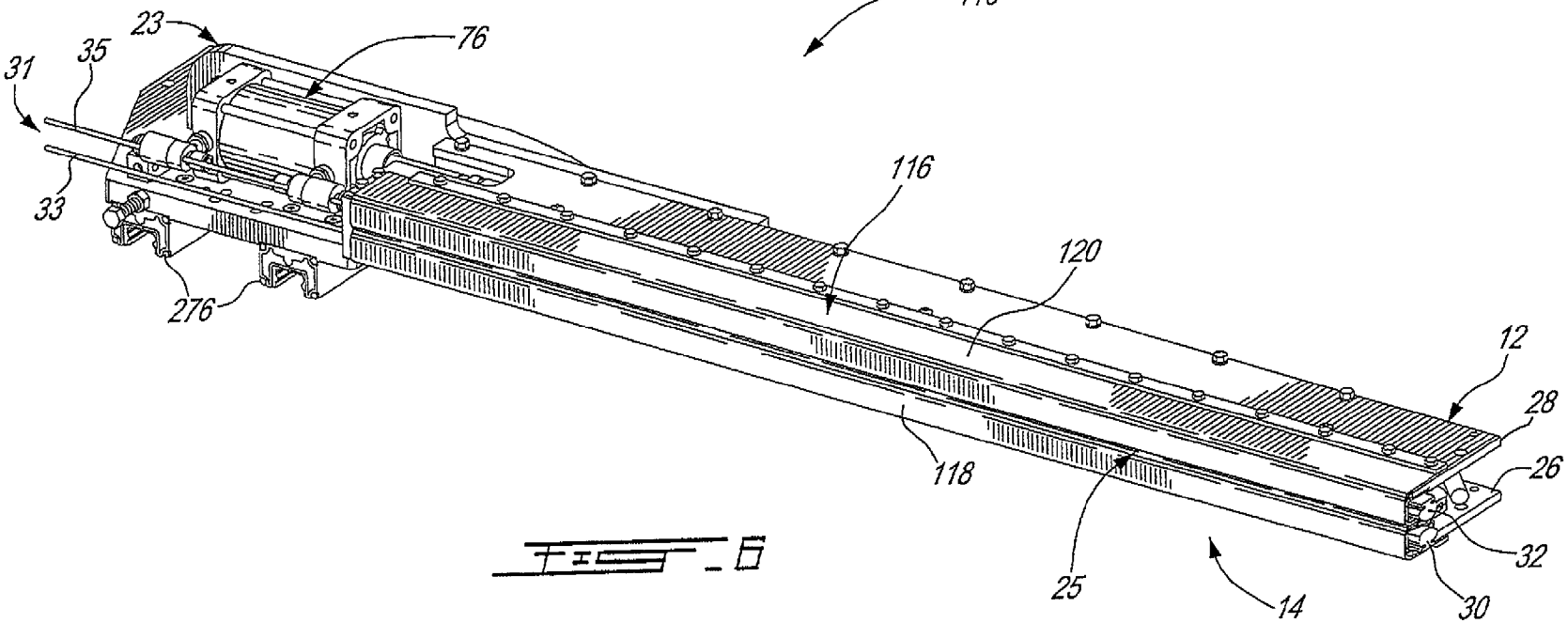
FIGS. 8A to 8E are partial cross-sectional representational views similar to FIGS. 7A and 7B showing the clamping member of FIG. 6 in operation.

Referring now to FIGS. 5A to 5B, a pair of clamping members 10A and 10B engages a folded film F having a pair of overlaying sheets S1 and S2 by being brought towards the film F with the clamping side 14 of each clamping member 10A and 10B being adjacent to a respective sheet S1 and S2. First, the gripping sides 14 of each clamping member 10A and 10B engage the sheets S1 and S2, respectively, as shown in FIGS. 5A and 5B. Then, the actuator 57 retracts deeper into the area 25 pulling the sheets 18 and 20 therewith which frictionally drag a portion of each sheet S1 and S2 as shown in FIG. 5C therebetween. Simultaneously, the clamping members 54 and 56 close, as shown in FIG. 4B, thereby clamping a portion of the sheets 18 and 20 with a portion of the sheets S1 or S2 therebetween. As shown in FIGS. 1C and 5D, the gripping members 30 and 32 swell up in order to add gripping pressure to the portion of the sheets S1 and S2 which have been sucked into the clamping area 25. Once the sheets S1 and S2 are firmly gripped as shown in FIG. 5D, the clamping members 10A and 10B are moved away from one another thereby separating the previously overlaying sheets S1 and S2 as shown in FIG. 5E.

With reference to FIGS. 6 to 8E, a second non-restrictive illustrative embodiment of the present invention will now be described so as to further exemplify the invention and by no means limit the scope thereof.

FIG. 6 shows a clamp 110 including an elongate main body 12 having a clamping side 114. Clamp 110 is substantially similar to clamp 10, in fact the differences between clamp 110 and clamp 10 are between their respective clamping sides 114 and 14. As such, mostly the differences between clamping members 110 and 10 will be discussed herein for concision purposes only. It should be noted that like reference numerals in the Figures regarding clamps 110 and 10 indicate like elements, whether or not these elements are described for a second time when discussing clamping member 110.

The external dragging surface 116 is defined by a pair of spaced apart dragging sheets 118 and 120 mounted to respective lip assemblies 122 and 124. An internal clamping area 25 extends from the pair of spaced apart dragging sheets 118 and 120 and is positioned therebetween. Each lip assembly 122 and 124 includes gripping members 30 and 32 respectively housed within an elongate supports 34 and 36 respectively and fed with pressure via the actuator 31 as previously described.

Portions of each dragging sheet 118 and 120 are interfaced within the internal clamping area 25 and joined together at common junction 137. The common junction 137 of the dragging surface 116 is mounted to actuator 57 for actuation thereof. The opposite ends 138 and 140 of the dragging sheets 118 and 120 respectively, are respectively fastened to the panels 26 and 28 of the longitudinal body via fasteners 42 and 44, respectively.

Figure 7A:
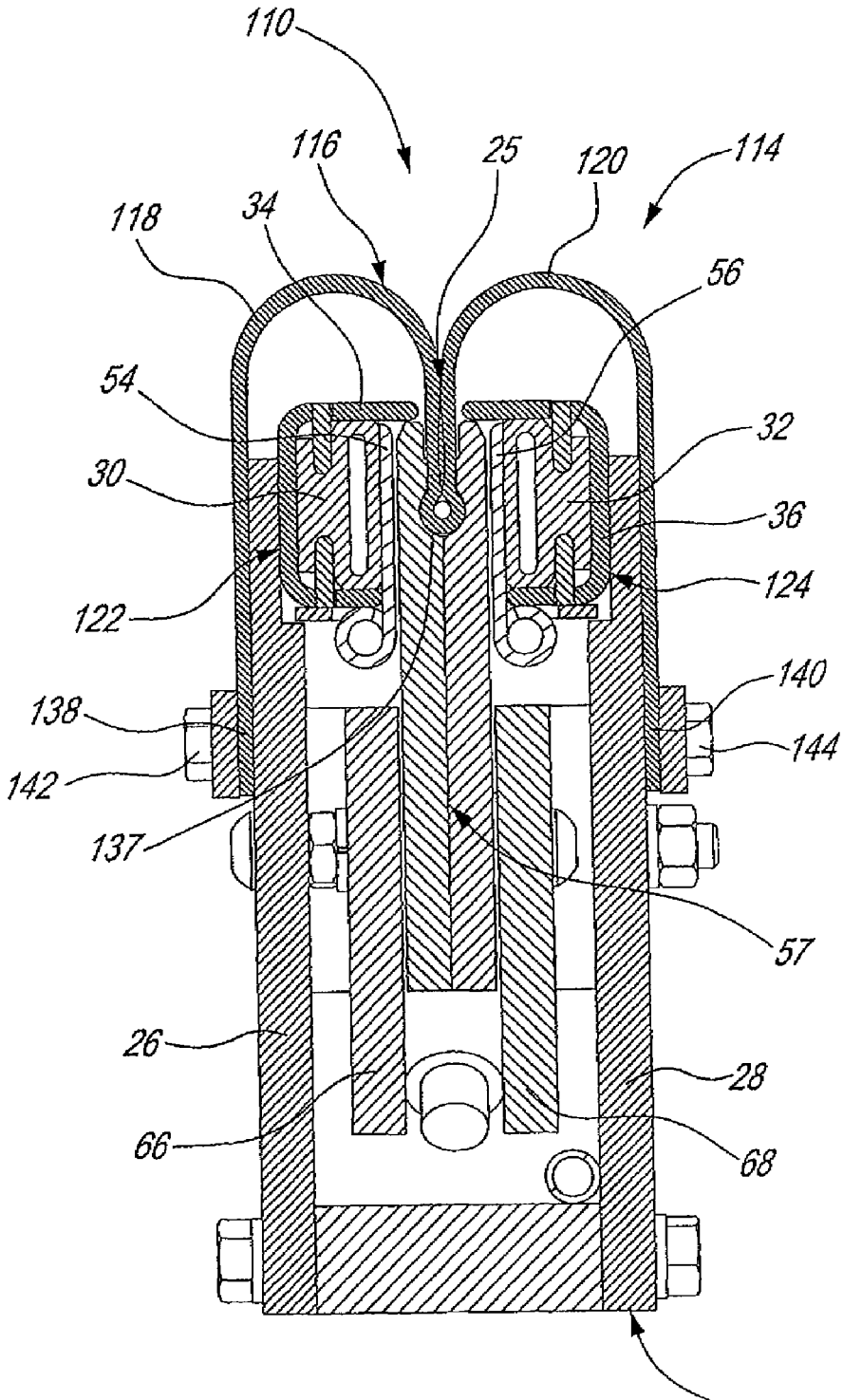
FIGS. 7A and 7B are respective partial cross-sectional views of the clamping member of FIG. 6 in operation.
Figure 7B:
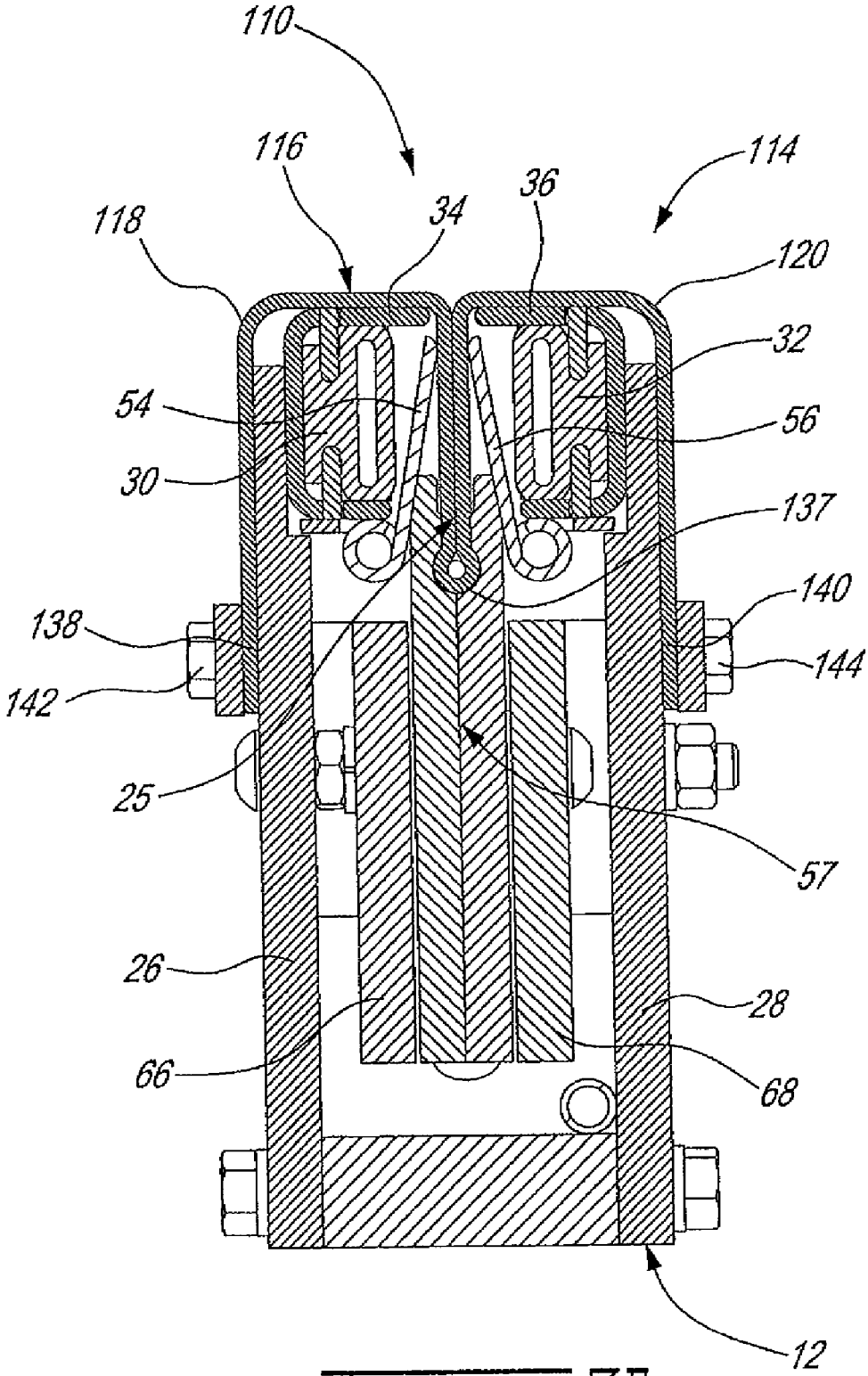

Similarly to clamp 10, the actuating assembly 76 causes the actuator 57 to move the common junction 137 outwardly of the clamping area 25 as shown in FIG. 7A and inwardly of the clamping area 25 as shown in FIG. 7*b*. When the sheets 116 and 120 are moved outwardly of the clamping area 25 they are "unrolled" as shown in FIG. 7A and hence provided with slack. When the sheets 116 and 120 are moved inwardly further into the clamping area they are "rolled" or pulled back and held tightly between the retracted actuator 57 acting on the common junction 137 and the fastened ends 138 and 140.

Figure 8A:
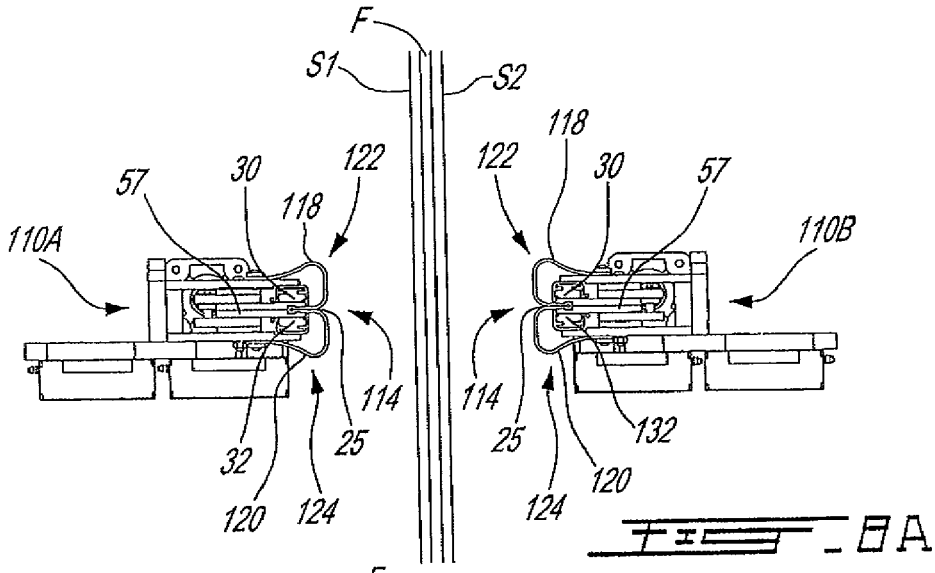
Figure 8B:
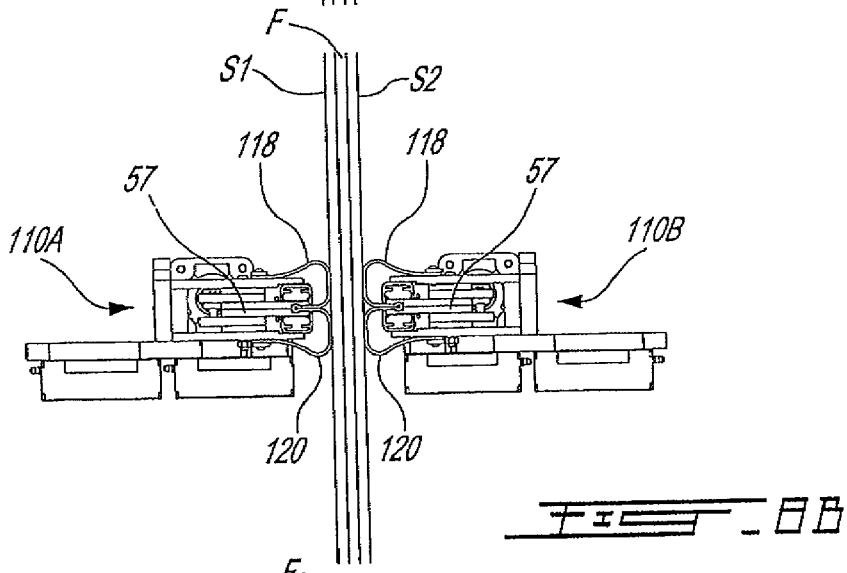
Figure 8C:
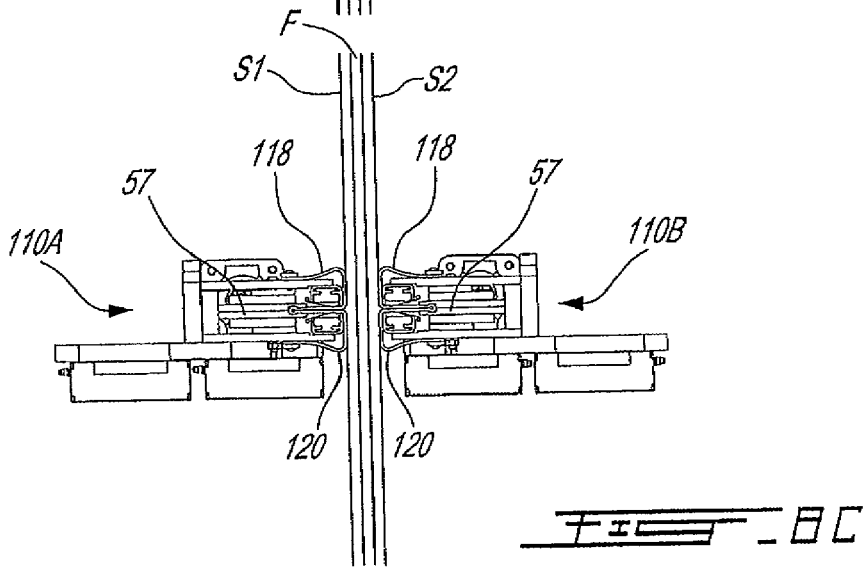
Figure 8D:
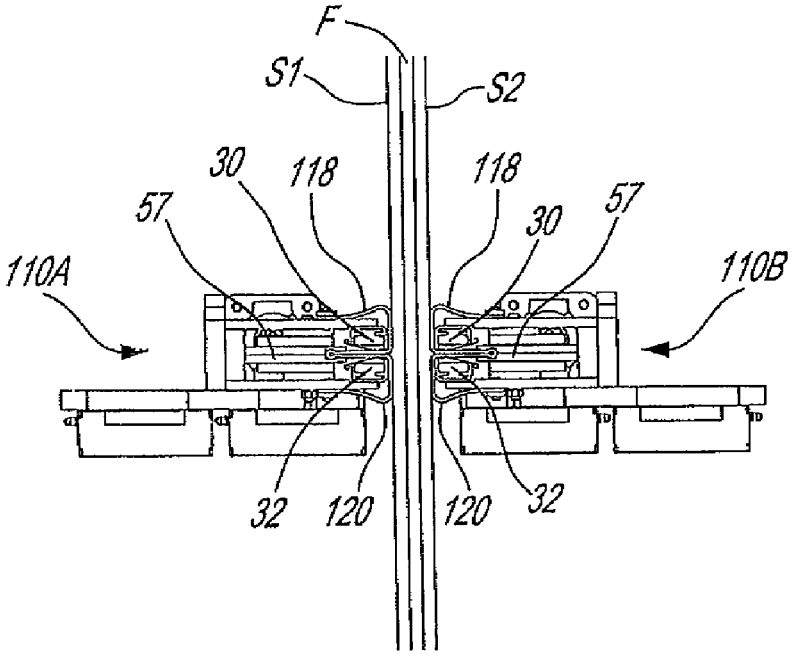
Figure 8E:
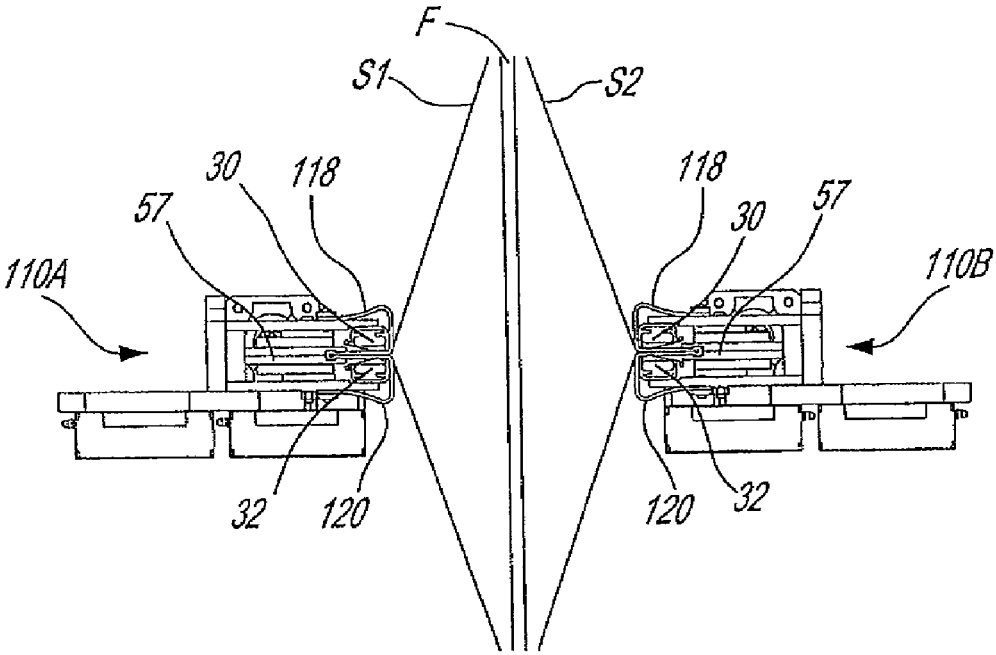

In operation, and with reference to FIGS. 8A to 8E pair of clamping members 110A and 110B respectively are moved towards and engage the overlaying sheets S1 and S2 of the film F as shown in FIGS. 8A and 8B. The sheets 118 and 120 are in the unrolled position (FIG. 7A) as they abut the sheets S1 and S2 as show in FIG. 8B. When the actuator 57 retracts deeper into the area 25 it retracts the sheets 118 and 120 therewith which frictionally drag a portion of each sheet S1 and S2 as shown in FIG. 8C into the clamping area 25 therebetween, enveloping this portion of each sheet S1 and S2. Simultaneously, the clamping members 54 and 56 close, as shown in FIG. 8B, thereby clamping a portion of the sheets 118 and 120 with a portion of the sheets S1 or S2 therebetween. As shown in FIG. 6 the gripping members 30 and 32 swell up in order to add additional gripping pressure to the portion of the sheets S1 and S2 which have been sucked into the clamping area 25. Once the sheets S1 and S2 are firmly gripped as schematically shown in FIG. 8D, the clamping members 110A and 110B are moved away from one another thereby separating the previously overlapping sheets S1 and S2 as shown in FIG. 8E.

The foregoing emulates a vacuum sucking action which pulls a portion of the sheets S1 and S2 inwardly between the lip assemblies 122 and 124 (or 22 and 24 for clamping member 10).

In both the clamping member 10 or clamping member 110 cases, once the sheets S1 and S2 are to be released, the pressure in the gripping members 30 and 32 is arrested and these members deflate back to their idle position. The actuator 57 pushes the common edges 37 or 137 outwardly of the clamping area thereby opening the pivotable clamping members 54 and 56 (as shown in FIGS. 4A and 7A) and the dragging sheets (18 and 20 or 118 and 120) are moved outwardly of the clamping area 25 pushing the formerly clamped portions of the overlaying film sheets S1 and S2 out of the clamping area 25 as well thereby releasing the film.

The action of the dragging surfaces 16 and 116 as well as the clamping members 54 and 56 and the gripping members 30 and 32 on the film sufficiently clamp a film F for manipulation thereof without damage thereto.

The sheets 18, 20, 118 and 120 can be made of variety of synthetic or polymeric materials, plastics, rubbers and the like. Their frictional dragging actions be accomplished by a variety of ways known in the art and as such the actuation and guiding systems described herein only serve as one example within the scope of the inventive concept. The sheets 18 and 20 are part of the same larger sheet defined by the dragging surface 16 and hence sheets 18 and 20 may be sheet portions of a single sheet. As such the sheet 16 includes an external portion 18 and 20 and an internal portion within the camping area 25. In another embodiment, these sheets 18 and 20 may be separate disconnected sheets having one end mounted to an actuator 57, yet their two ends mounted to the same actuator 57 together define their common junction. In either case the dragging surface 16 envelopes the portion of sheet material it engages and frictionally drags the portion into the clamping area 25. The foregoing also applies for sheets 118 and 120 of dragging surface 116.

In another non-illustrated embodiment, the dragging surface comprises rollers for rollingly and frictionally engaging a portion of the sheet material to rollingly drag this portion into the clamping area.

The clamping members and the clamping sides thereof can be provided in a number of suitable configurations other than the longitudinal designs illustrated herein as examples.

The gripping members 30 and 32 can be provided in a variety of sizes and configurations. In fact, a variety of moveable gripping, clamping, pinching, securing, tightening members and the like such as members 30, 32, 54 and 56 which engage the portions of material dragged into the clamping area either by translational movement, or by swelling, inflation and the like can be used in order to tightly clamp the sheet of material without damage thereto. In fact, in other non-illustrated embodiments, the sheets 18 and 20 or 118 and 120 are sufficiently close to one another within the clamping area 25 and they are sufficiently retracted within the clamping area 25 as to clamp the portion of dragged sheet material without the use of any additional grippers, clampers, and the like.

Figure 9:
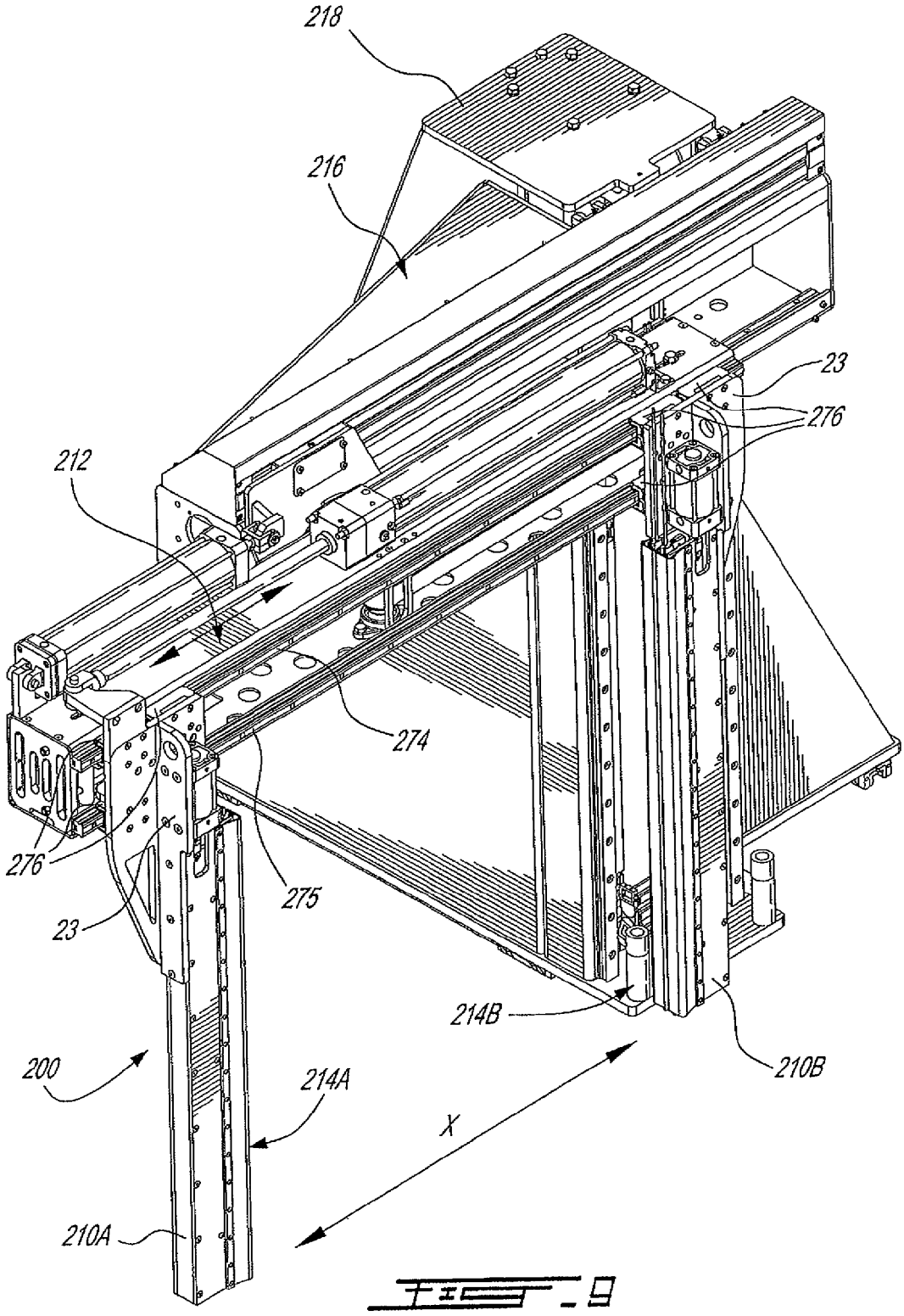
FIG. 9 is a perspective view of a clamping device in accordance with non-restrictive illustrative embodiment of the present invention.

With reference to FIG. 9, a clamping device 200 is shown including a pair of clamps 210A and 210B. Clamps 210A and 210B are similarly constructed to clamps 110 and 110 previously discussed.

The clamping device 200 can be provided in a variety of configurations and constructions, in this example, the clamping members 210 and 210B are movable along the longitudinal length of a mobile arm 212, with their clamping sides 214A and 214B facing each other, to reciprocally move in the direction shown by arrow X for approaching overlaying sheets therebetween, engaging each overlaying sheet, clamping each overlaying sheet and moving the sheets away from one another as discussed and shown in FIGS. 5A to 5D and 8A to 8D. The mobile arm 212 includes rails, which are engaged by bearing guide members 276 mounted to the support structures 23 of each clamping member 214A and 214.

The mobile arm 212 is mounted to an elevator support 216 so as to be movable along the longitudinal length of the support 216 and as to be pivotable relative to support 216. Elevator support 216 is mounted to a carriage 218 so as to be movable along the vertical length of this carriage 218. The carriage 218 may also be movable along the length of a railing 220 shown in FIG. 10.

Figure 10:
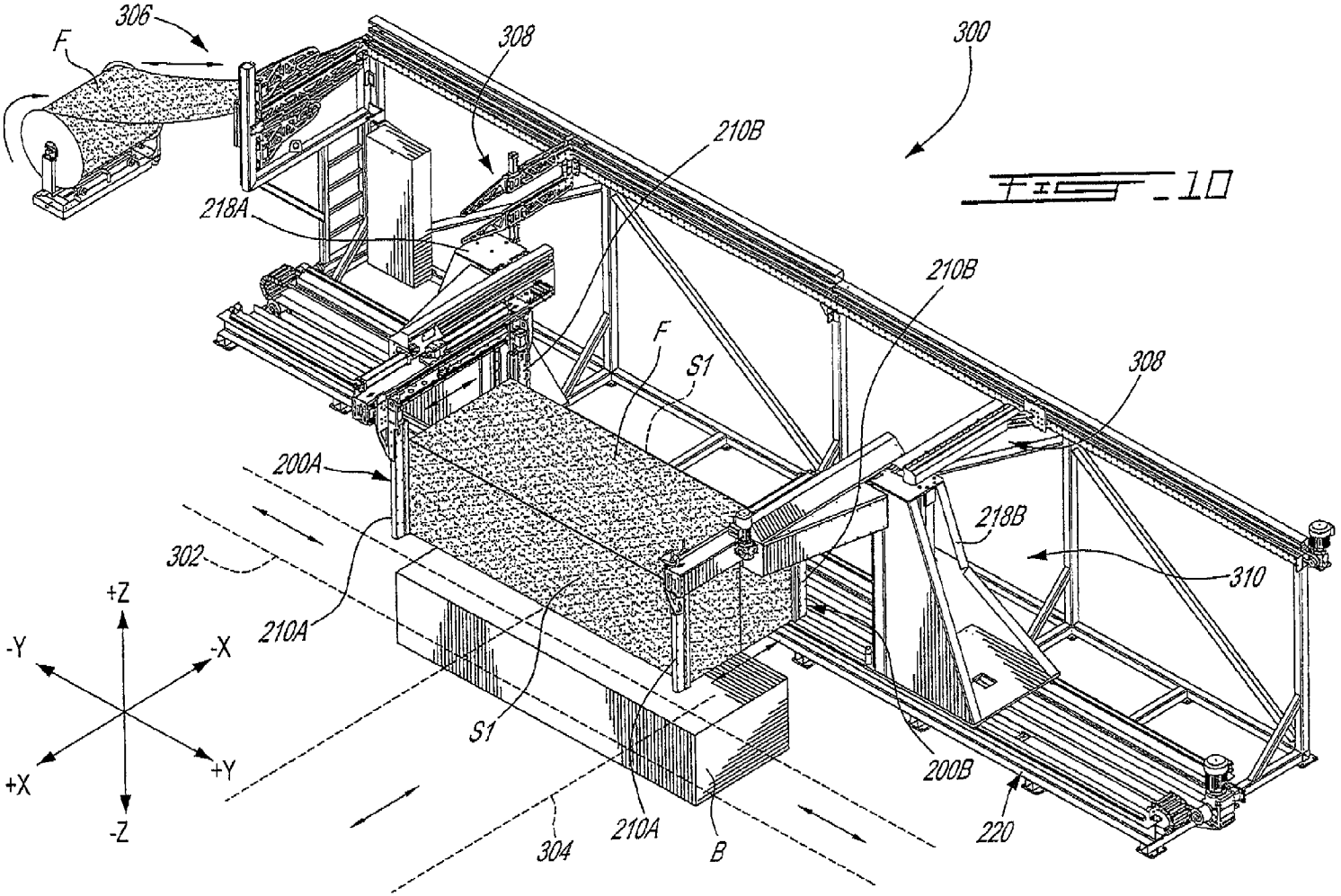
FIG. 10 is a perspective view of an apparatus for bagging material in accordance with a non-restrictive illustrative embodiment of the present invention.

With reference to FIG. 10, an apparatus 300 for bagging material B in a bundle is shown in accordance with a non limiting example of the present invention.

The apparatus 300 is an assembly of sub-apparatuses including a first load transfer 302 for conveying the load B in the −Y and +Y directions, a second load transfer 304 for conveying the load 12 in the +X and −X directions, a film dispensing and cutting assembly 306, a film conveying device 308 for conveying film in the −Y and +Y directions, and a film stretching and bagging device 310 which includes the clamping devices 200A and 200B. As such the stretching and bagging device 310 includes a pair of left and right moveable carriages 218A and 218B moveably mounted on the railing 220 carrying the clamping devices 200A and 200B respectively.

Hence, the present apparatus 300 provides for clamping a film F with the clamp devices 200A and 200B. The clamping members 210A of each device 200A and 200B clamp a side S1 of the film F, the clamping members 210B of each device 200A and 200B clamp a side S1 and S2 of the film F. The carriages 218A and 218B move away from each other stretching the film. The clamping members 210A and 210B of each device 200A and 200B also move away from each other opening the film F to form a bag. The bag F covers the bundle B as the devices 200A and 200B lower the opened and stretched bag F onto the bundle B. Once the bundle B has been covered, the clamping members 210A and 210B of both devices 200A and 200B release the bag F onto the bundle B and move away from the covered bundle B to engage another length of film F.

Furthermore and is apparent to the skilled artisan in view of the present description, the present invention also provides a method of clamping overlaying sheets of material including at least a first sheet and a second sheet. This method comprising engaging the first and second sheets with a respective dragging surface, then frictionally dragging a portion of each first and second sheets into a respective crevice contiguous with each dragging surface and subsequently clamping the portions of the first and second sheets with the respective crevices.

It should be understood that the various features and characteristics of the various previously described embodiments as well as the non-restrictive Figures can be combined and modified in a variety of ways to provide still other non-restrictive embodiments within the scope of the invention.

It is to be understood that the invention is not limited in its application to the details of construction and parts illustrated in the accompanying drawings and described hereinabove. The invention is capable of other embodiments and of being practiced in various ways. It is also to be understood that the phraseology or terminology used herein is for the purpose of description and not limitation, Furthermore, the drawings form part of the specification and hence, elements, features, advantages, concepts which have been illustrated are supportive of the inventive concept herein. Hence, although the present invention has been described hereinabove by way of preferred embodiments thereof, it can be modified, without departing from the spirit and nature of the subject invention as defined in the appended claims.

What is claimed is:

1. A method of clamping overlaying sheets of material including at least a first sheet and a second sheet, said method comprising:

engaging the first and second sheets with a respective pair of dragging sheets mounted to a clamping member comprising respective fixed ends thereof being fixed to a first part of the clamping member and respective opposite retractable ends being retractable towards a second part of the clamping member;

frictionally dragging a portion of each first and second sheets between the respective pair of dragging sheets when retracting the retractable ends thereof; and clamping the portions of each first and second sheets.

2. A method according to claim 1, wherein said clamping comprises inflating respective inflatable members about the portions.

3. A method according to claim 1, wherein said clamping comprises engaging the portions between respective pivotable clamping members.

4. A method according to claim 1, further comprising moving the clamped sheets away from one another.

5. A method of clamping overlaying sheets of material including at least a first sheet and a second sheet, said method comprising:

engaging the first and second sheets with a respective dragging surface mounted to a clamping member;

frictionally dragging a portion of each of the first and second sheets into respective internal clamping areas defined by a clamping member and contiguous with each dragging surface; and clamping the portions of the first and second sheets within the respective internal clamping areas.

6. A method according to claim 5, further comprising moving the clamped sheets away from one another.

* * * * *